US005152441A

United States Patent [19]

Torena

[11] Patent Number: 5,152,441

[45] Date of Patent: Oct. 6, 1992

[54] TOOL BACK PACK APPARATUS

[76] Inventor: Kenneth M. Torena, 14322 Hurst St., Norwalk, Calif. 90650

[21] Appl. No.: 675,863

[22] Filed: Mar. 27, 1991

[51] Int. Cl.[5] ..... A45F 3/08

[52] U.S. Cl. ..... 224/210; 224/148; 224/214; 224/223; 224/209; 312/902; 222/175; 222/386; 206/373

[58] Field of Search ..... 224/209, 210, 211, 213, 224/214, 148, 223; 206/372, 373, 375, 376; 312/DIG. 33; 222/175, 386, 95

[56] References Cited

U.S. PATENT DOCUMENTS

| | | | |
|---|---|---|---|
| 258,814 | 5/1882 | Scott | 312/DIG. 33 |
| 2,836,334 | 5/1958 | Davis | 224/210 |
| 3,549,064 | 12/1970 | Wilson | 224/209 |
| 4,874,119 | 10/1989 | Winter | 206/373 |

FOREIGN PATENT DOCUMENTS

| | | | |
|---|---|---|---|
| 70265 | 4/1915 | Austria | 224/209 |
| 1017357 | 12/1952 | France | 224/210 |
| 144962 | 4/1954 | Sweden | 206/373 |

*Primary Examiner*—Linda J. Sholl
*Attorney, Agent, or Firm*—Leon Gilden

[57] ABSTRACT

An apparatus including a central container housing, with a right, left, top, and bottom flexible ring member securable through a container housing, with each ring member and container including a matrix of loops for securement of a tool assemblage. A plurality of shoulder straps are formed to a rear surface of the floor for permitting mounting and transport of the organization to an individual. The invention may further include extensible legs retractably mounted within support columns formed within the central housing container for mounting of the organization in a vertical orientation for access during use.

4 Claims, 4 Drawing Sheets

TOOL BACK PACK APPARATUS

BACKGROUND OF THE INVENTION

1. Field of the Invention

The field of invention relates to tool apparatus, and more particularly pertains to a new and improved tool back pack apparatus wherein the same is arranged for ease of transport by individuals.

2. Description of the Prior Art

Back pack assemblages of various types are utilized in the prior art to transport and mount various structures for use in particular environments. Examples of such organizations may be found for example in U.S. Pat No. 4,561,576 to Lowe, et al. wherein a bag structure mounts video equipment therewithin. U.S. Pat No. 2,656,869 to Timmons sets forth a tool kit structure formed with a flexible tether line handle formed to an upper terminal end edge of the housing for ease of positioning of the structure to a bumper of a motor vehicle.

U.S. Pat. No. 1,296,421 sets forth a tool bag formed of a flexible construction.

U.S. Pat. No. 274,621 to Kegevic sets forth a tool kit formed with various pockets and the like for use in securing tool members therewithin.

As such, it may be appreciated that there continues to be a need for a new and improved tool back pack apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of tool case construction now present in the prior art, the present invention provides a tool back pack apparatus wherein the same sets forth a tool back pack apparatus arranged for ease of mounting to an individual for transport of the back pack structure. As such, the general purpose of the present invention, which will be described subsequently in greater detail, is to provide a new and improved tool back pack apparatus which has all the advantages of the prior art tool package apparatus and none of the disadvantages.

To attain this, the present invention provides an apparatus including a central container housing, with a right, left, top, and bottom flexible ring member securable through a container housing, with each ring member and container including a matrix of loops for securment of a tool assemblage. A plurality of shoulder straps are formed to a rear surface of the floor for permitting mounting and transport of the organization to an individual. The invention may further include extensible legs retractably mounted within support columns formed within the central housing container for mounting of the organization in a vertical orientation for access during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool back pack apparatus which has all the advantages of the prior art tool package apparatus and none of the disadvantages.

It is another object of the present invention to provide a new and improved tool back pack apparatus which may be easily and efficiently manufactured and marketed.

It is a further object of the present invention to provide a new and improved tool back pack apparatus which is of a durable and reliable construction.

An even further object of the present invention is to provide a new and improved tool back pack apparatus which is susceptible of a low cost of manufacture with regard to both materials and labor, and which accordingly is then susceptible of low prices of sale to the consuming public, thereby making such tool back pack apparatus economically available to the buying public.

Still yet another object of the present invention is to provide a new and improved tool back pack apparatus which provides in the apparatuses and methods of the prior art some of the advantages thereof, while simultaneously overcoming some of the disadvantages normally associated therewith.

Still another object of the present invention is to provide a new and improved back pack apparatus wherein the same is arranged for ease of mounting to an individual and for convenience in positioning the structure in use in a free-standing arrangement.

These together with other objects of the invention, along with the various features of novelty which characterize the invention, are pointed out with particularity in the claims annexed to and forming a part of this disclosure. For a better understanding of the invention, its operating advantages and the specific objects attained by it uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 to 8 thereof, a new and improved tool back pack apparatus embodying the principles and concepts of the present invention and generally designated by the reference numberal 10 will be described.

Figure 1:
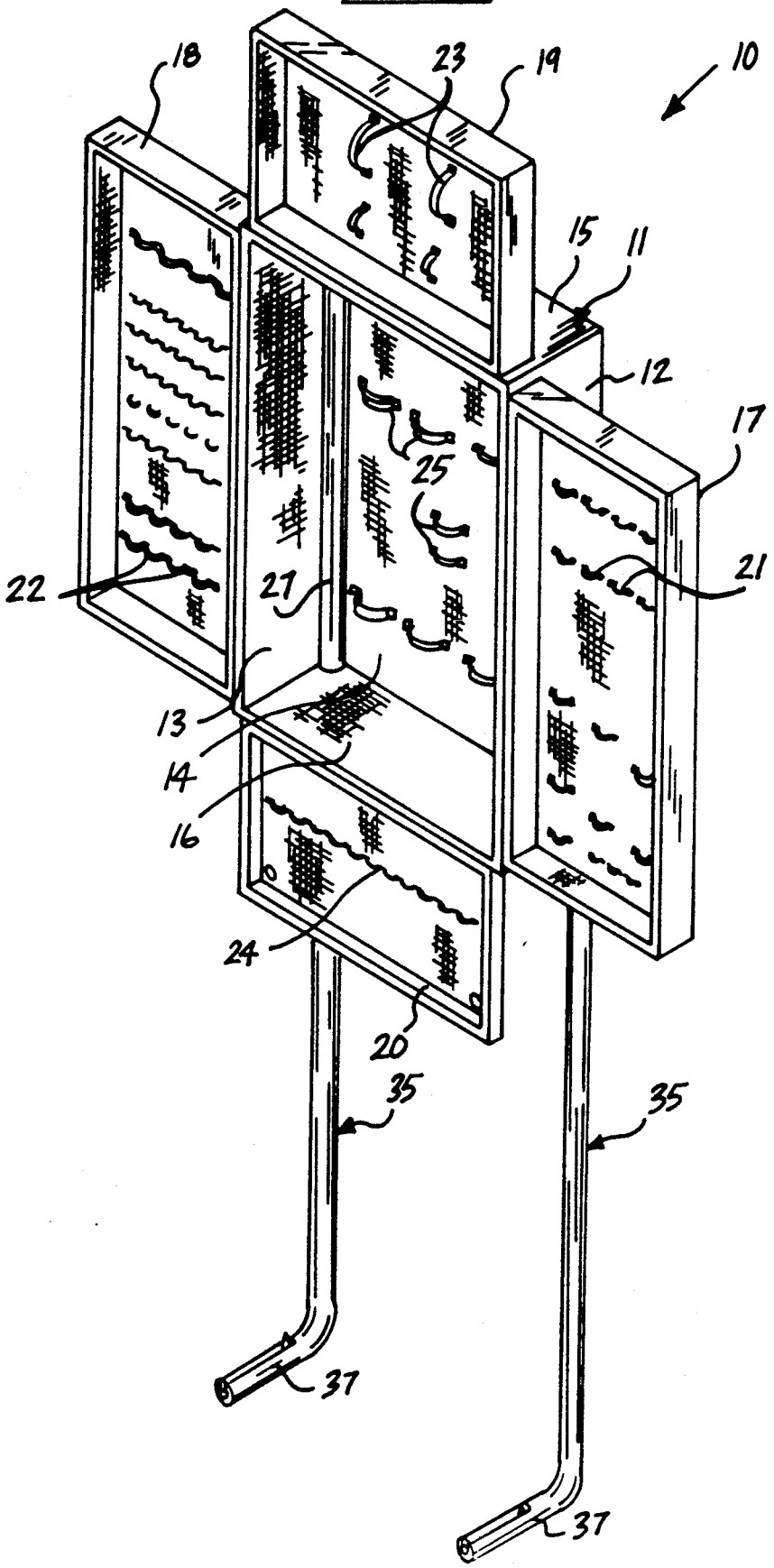
FIG. 1 is an isometric illustration of the instant invention with a first wing arrangement.

More specifically, the tool back pack apparatus 10 of the first embodiment as seen in FIG. 1 essentially comprises a central container housing 11, including a right wall 12, a left wall 13, a top wall 15, and a bottom wall 16, each orthogonally mounted to a rear wall floor 14. Each of the walls includes an upper edge, with each wall including a respective wing member pivotally mounted to each wall adjacent each respectivce upper edge of each wall. More specifically, a right flexible cover wing 17 is pivotally mounted to the right wall adjacent its upper terminal edge, with a left cover wing 18 mounted to the left wall 13 adjacent the left wall upper terminal edge, a top flexible cover wing 19 mounted to the top wall adjacent the top wall's upper terminal edge, and a bottom flexible cover wing mounted to the bottom wall adjacent the upper terminal edge of the bottom wall, with each of the flexible cover wings including a series of securement loops. More specifically, a matrix of first loops 21 is mounted within the right cover wing, a matrix of second loops 22 mounted within the left cover wing, third loops 23 defining a matrix are mounted within the top wall 19, and a matrix of fourth loops 23 are mounted within the bottom wing 20. Fifth loops 25 are mounted within the housing 11 onto the rear wall floor 14. A plurality of shoulder strap pairs 34 (see FIGS. 4 and 5) are mounted to a rear surface of the rear wall 14 for securement about an individual to permit ease of transport of the organization.

Figure 2:
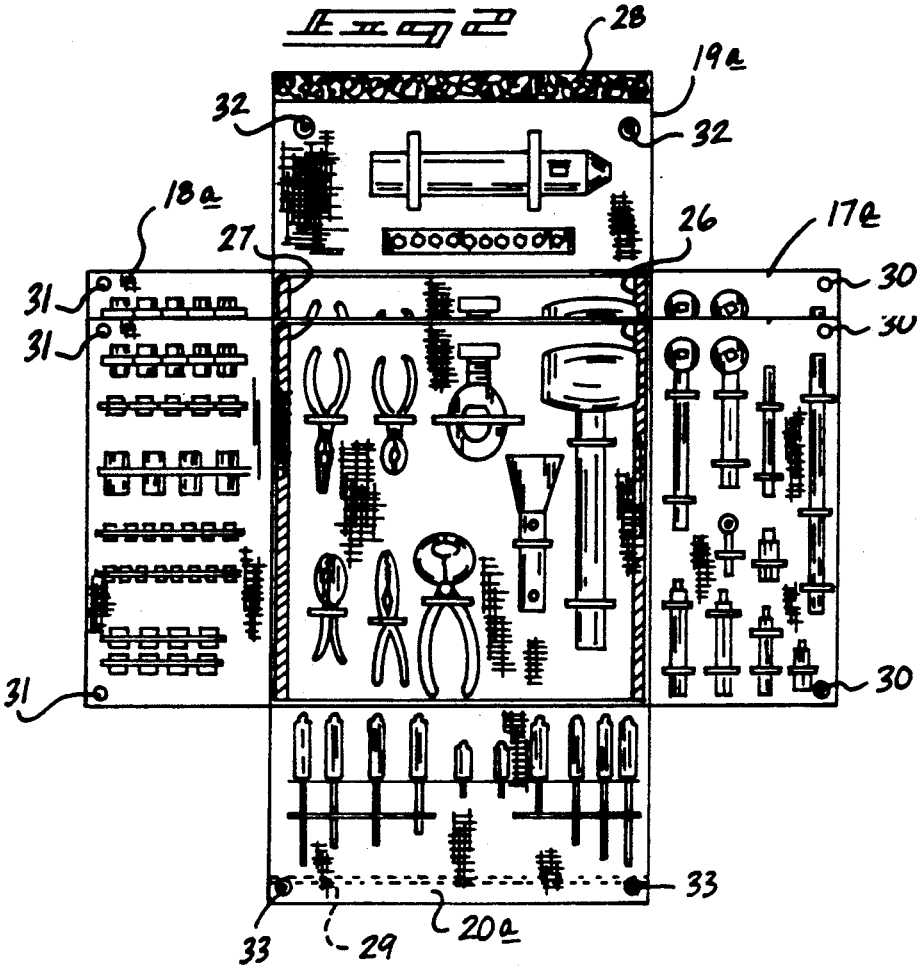
FIG. 2 is an orthographic frontal view of the instant invention with a second wing arrangement.
Figure 3:
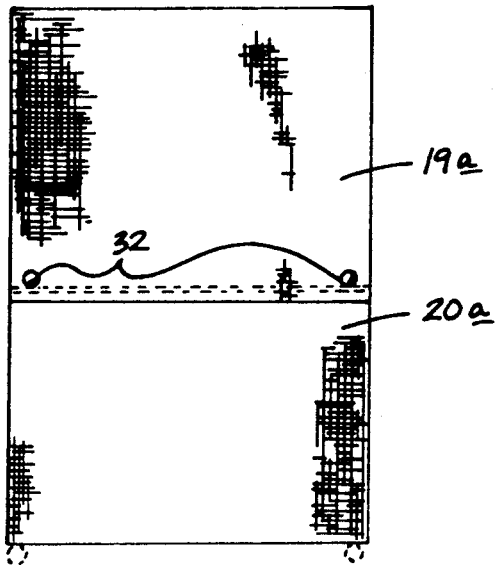
FIG. 3 is an orthographic frontal view of the invention in a closed configuration.
Figure 4:
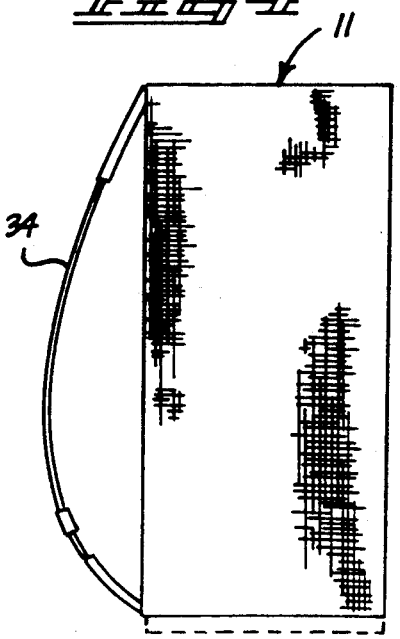
FIG. 4 is an orthographic side view of the instant invention.
Figure 5:
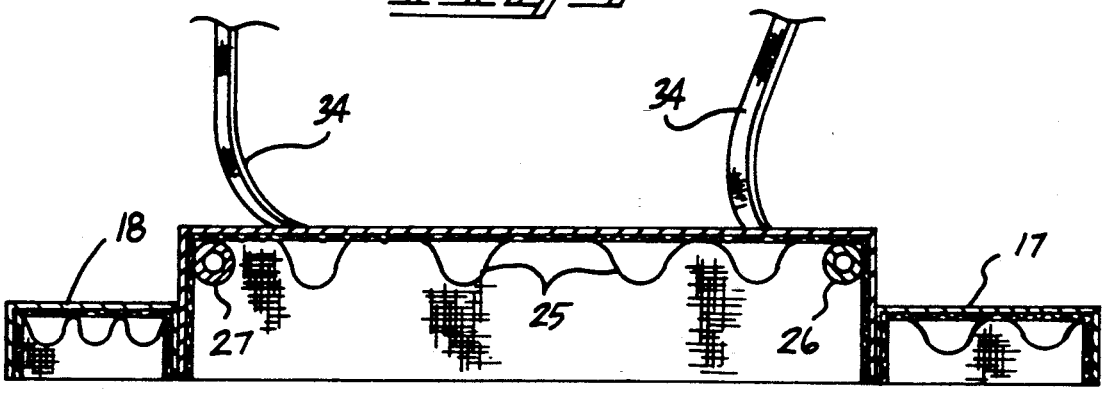
FIG. 5 is an orthographic cross-sectional illustration of the back pack structure.
Figure 6:
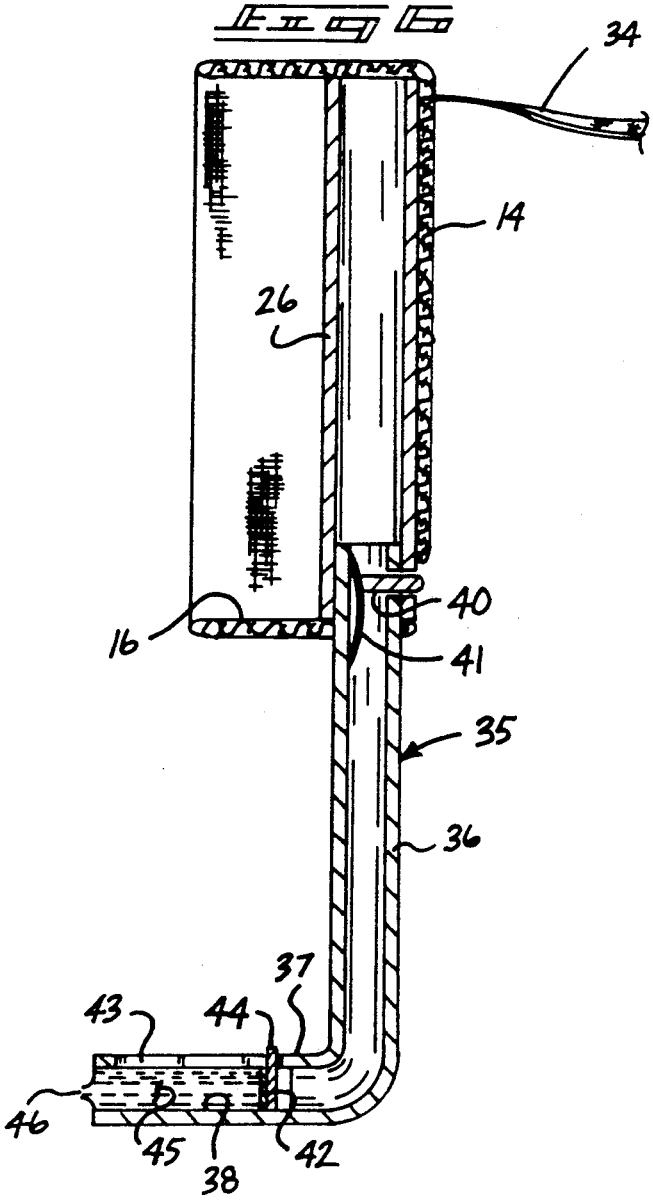
FIG. 6 is a further orthographic cross-sectional illustration of the invention setting forth details to the supporting leg structure.

FIG. 2 illustrates the various tools mounted within the loop structure, to include ratchet wrenches, extensions, and the like mounted within the matrix of first loops 21. Sockets and the like are mounted within the second loops 22, a cordless screw driver and associated fittings are mounted within the third loops 23, screw drivers are mounted within the fourth loops 24, and an array of pliers, a hammer, a scrapping tool, and a nut splitter is mounted within the fifth loops 25. The organization of the second embodiment, as illustrated in FIG. 2, sets forth the use of cover wing webs 17*a*, 18*a*, 19*a*, and 20*a*, with the top web 19*a* including a first hook and loop fastener strip 28 securable to a second hook and loop fastener strip 29 mounted to a terminal edge of the bottom web 20. Further, first snap fasteners 30 mounted to the right web 17*a* are cooperative with second snap fasteners 31. Third snap fasteners 32 mounted to the top web 19*a* are cooperative with fourth snap fasteners 33.

"L" shaped support legs 45 are each telescopingly received within respective right and left tubular columns 26 and 27 that are coextensively mounted within the container housing 11 at an intersection of the floor 14 and the respective right and left walls 12 and 13. The tubular columns 26 and 27 are coextensively directed along an intersection of the right and left walls and the respective floor 14. The tubular columns 26 and 27 each telescopingly mount an "L" shaped support leg 35 therewithin. Each "L" shaped support leg is defined by a vertical leg member 36 that is orthogonally oriented relative to the bottom wall 16, and a horizontal leg 37 that is arranged parallel relative to the bottom wall 16. The horizontal leg 17 includes a leg cavity 38, wherein a locking aperture is directed through the floor 14 to receive a locking peg 40 mounted within the vertical leg member 36 of "L" shaped support leg 35 that is biased exteriorly of the horizontal leg member 37 by a spring member 41 contained within an upper portion of the horizontal leg member 37.

The horizontal leg member 37 includes a plunger piston plate 42 fixedly mounted to a plunger leg that extends through a slot 43 that is coextensively directed along a wall of the horizontal leg member 37. The slot 43 accepts the plunger leg 44 to permit extrusion of a hand cleaner paste 45 from within the horizontal leg cavity 38. the hand cleaner paste 45 is directed through a nozzle 46 for use by an individual to permit cleaning of an individual's hand subsequent to use of the tools mounted within the structure.

Figure 7:
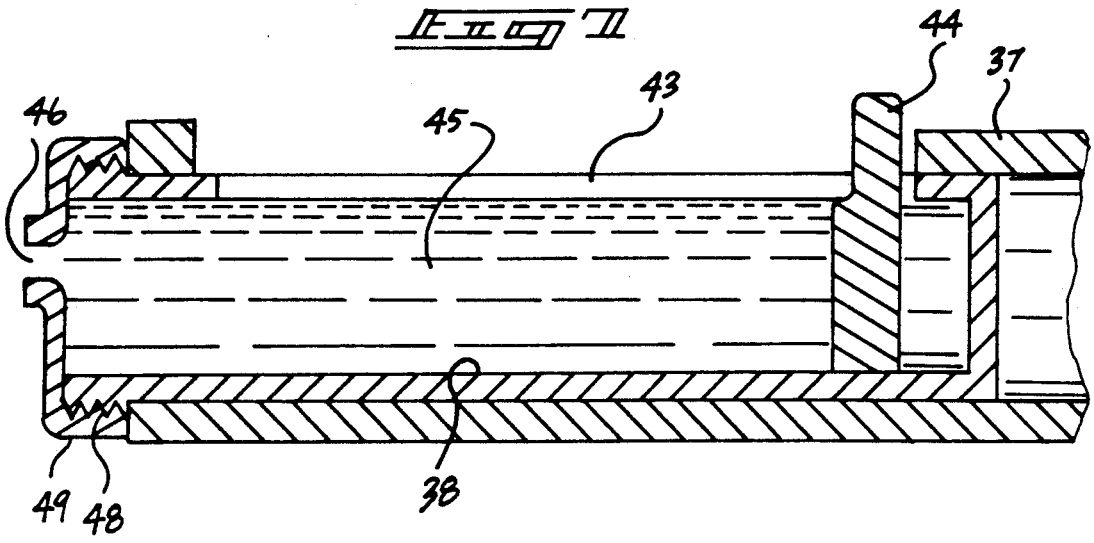
FIG. 7 is an enlarged orthographic cross-sectional illustration of the horizontal leg structure of the instant invention.
Figure 8:
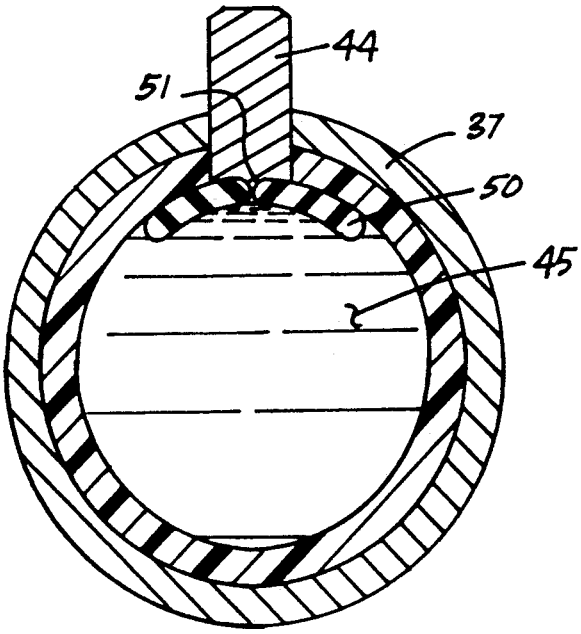
FIG. 8 is an orthographic cross-sectional illustration of the horizontal leg structure, as illustrated in FIG. 7.

Reference to FIG. 7 illustrates that the horizontal leg 37 includes an externally threaded boss 48 to threadedly receive an internally threaded skirt 49 of a cap mounting the nozzle 46 coaxially therethrough in coaxial alignment to the horizontal leg 37. The plunger leg 44 is projected through a seal 50 that is coextensive with the slot 43 (see FIG. 8), wherein the seal 50 includes a slit 51 medially thereof to surround the leg 44 preventing extrusion of the hand cleaner paste 45 through the slot 43.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A tool back pack apparatus comprising, in combination, a central container housing, the central container housing including a right wall spaced from a left wall, a top wall spaced from a bottom wall, and each of the right, left, top, and bottom walls orthogonally mounted to a floor, and a right flexible cover wing web mounted to the right wall, a left flexible cover wing web mounted to the left wall, a top flexible cover wing web mounted to the top wall, and a bottom flexible cover wing web mounted to the bottom wall, and first fastening means mounted to the right flexible cover wing web, and second fastening means mounted to the left flexible cover wing web, with the first fastening means arranged for selective securement to the second fastening means, and third fastening means mounted to the top flexible cover wing web, and fourth fastening means mounted to the bottom flexible cover wing web, wherein a third flexible fastening means is arranged for selective securement to the fourth fastening means, and a first matrix of loops mounted to an interior surface of the right flexible cover wing web securing a first quantity of tools therewithin, and a second matrix of loops mounted to an interior surface of the left flexible cover wing web mounting a second quantity of tools, and a third matrix of loops mounted to an interior surface of the top flexible cover wing web securing a third quantity of tools therewithin, and a fourth matrix of loops mounted to an interior surface of the bottom flexible covering web securing a fourth quantity of tools, and a fifth matrix of loops mounted to an interior surface of the floor securing a fifth quantity of tools therewithin, and a right tubular column coextensively mounted to a first intersection defined by intersection to the floor and the right intersection defined by intersection of the floor and the right wall, and a left tubular column mounted to a second intersection defined by intersection of the floor and the left wall, and each tubular column telescopingly receiving an L-shaped support leg therewithin, and the L-shaped support leg including a vertical leg member orthogonally oriented relative to the bottom wall, and a horizontal leg member oriented parallel relative to the bottom wall, and a plurality of shoulder straps mounted to a rear surface of the floor exteriorly of the central housing container for selective securement to an individual to transport the apparatus, and the horizontal leg member includes a cavity, the cavity includes a piston plate slidably mounted therewithin, the piston plate including a piston leg, and the horizontal leg includes a slot directed through the horizontal leg, with the slot slidably guiding and receiving the piston leg therethrough, and a predetermined quantity of hand cleaner paste mounted within the horizontal leg cavity, and the horizontal leg including a nozzle coaxially aligned with the horizontal leg mounted at a free terminal end of the horizontal leg to permit extrusion of the hand cleaner paste through the nozzle upon compression of the hand cleaner paste by manually directing the plunger piston plate against the hand cleaner paste by manually manipulating the piston leg through the slot.

2. An apparatus as set forth in claim 8 wherein the nozzle is coaxially mounted within a cap member, and the cap member includes an internally threaded skirt, and the horizontal leg includes an externally threaded boss formed at a free end of the horizontal leg, wherein the internally threaded skirt is selectively securable to the externally threaded boss.

3. An apparatus as set forth in claim 2 wherein the horizontal leg cavity includes a seal formed coextensively within the horizontal leg cavity in contiguous communication with the slot, and the seal including a slit directed coextensively thereof, with the piston leg directed through the slit to contain the hand cleaner paste within the horizontal leg cavity upon compression of the hand cleaner paste by the piston plate.

4. An apparatus as set forth in claim 3 wherein each vertical leg includes a locking peg mounted therewithin, the locking peg is biased exteriorly relative to each vertical leg, with a spring member mounted within each vertical leg biasing the locking peg exteriorly of the vertical leg, and the locking peg selectively positionable through a locking aperture directed through the floor of the container housing when the vertical leg is in an extended configuration relative to the bottom wall.

* * * * *